US006286495B1

(12) United States Patent
Brown

(10) Patent No.: US 6,286,495 B1
(45) Date of Patent: Sep. 11, 2001

(54) SLINGSHOT LINE DISPENSER

(76) Inventor: E. Allen Brown, 8645 Tower Dr., Laurel, MD (US) 20723

( * ) Notice: Subject to any disclaimer, the term of this patent is extended or adjusted under 35 U.S.C. 154(b) by 0 days.

(21) Appl. No.: 09/631,031

(22) Filed: Aug. 2, 2000

Related U.S. Application Data

(60) Provisional application No. 60/160,764, filed on Oct. 21, 1999.

(51) Int. Cl.[7] ..... F41B 3/02
(52) U.S. Cl. ..... 124/20.1
(58) Field of Search ..... 124/20.1, 20.3

(56) References Cited

U.S. PATENT DOCUMENTS

| | | | |
|---|---|---|---|
| D. 398,696 | 9/1998 | Gunn | D22/106 |
| 2,948,078 | 8/1960 | Miotke | 43/19 |
| 3,108,583 | 10/1963 | Andis | 124/22 |
| 4,014,126 | 3/1977 | Samuels et al. | 43/19 |
| 4,583,513 | 4/1986 | Ellenburg et al. | 124/20.2 |
| 4,587,943 | 5/1986 | Ross | 124/20.1 |
| 5,363,584 | 11/1994 | Lo | 43/19 |
| 5,501,207 | 3/1996 | Black | 124/20.1 |
| 6,053,156 * | 4/2000 | Boon | 124/20.1 |

FOREIGN PATENT DOCUMENTS

| | | |
|---|---|---|
| 2067082 | 1/1980 | (GB) . |
| 2035106 | 6/1980 | (GB) . |
| 2262019 | 6/1993 | (GB) . |
| 80964 | 11/1952 | (NO) . |

* cited by examiner

*Primary Examiner*—John A. Ricci
(74) *Attorney, Agent, or Firm*—Richard C. Litman

(57) ABSTRACT

A slingshot line dispenser and method for deploying radio antennas, the slingshot line dispenser having a Y-shaped body, forearm rest portion, a forwardly extended combination reel and mounting element from the Y-shaped body, and an energy absorbing element for casting a weighted object attached to the reel. The mounting element is a substantially cylindrical wire having a uniform area, but varies in slope. The reel is mounted to the wire mounting element at a location where the slope of the wire mount is a maximum. An energy storage element is attached to the free ends of the Y-shaped sling shot body in a conventional way for propelling the weighted line. The slingshot line dispenser Y-shaped body and forearm rest portion is manufactured as a single unitary structure, The forearm rest or alternatively brace portion has a V-shape and includes an arcuate C-shaped member attached thereto. The body or frame of the line dispenser is constructed of a sturdy and lightweight material. A method of using the device for deploying an antenna above tall objects is also disclosed. Another configuration of the device includes the reel attached rearward of the Y-shaped body element.

7 Claims, 5 Drawing Sheets

SLINGSHOT LINE DISPENSER

CROSS-REFERENCE TO RELATED APPLICATION

This application claims the benefit of U.S. Provisional Patent Application Ser. No. 60/160,764, filed Oct. 21, 1999.

BACKGROUND OF THE INVENTION

1. Field of the Invention

The present invention relates generally to a sling shot line dispenser More specifically, the invention is a sling shot line dispensing apparatus and method for deploying radio antennas over tall objects for amateur radio operations.

2. Description of Related Art

Numerous slingshot devices have been devised for a variety of different applications. The primary area of application of such devices has been in the fishing industry for propelling weighted bait within a body of water. The slingshot mechanism in most instances is adapted to a fishing rod for use thereon. The advantage that this type of arrangement provides for the fisherman is the ease in deployment of a baited line, and the reduction in the exerted effort by a user for manually casting a weighted line without the use of such a device. While the basic structural features of the slingshot have not changed, multiple features of the device have been salient points of the various designs now available. The unique difference of the device as herein described compared to conventional slingshot devices is that it is an improved slingshot device and method for deploying radio antennas for amateur radio operations. A slingshot device and method which utilize a cantilevered construction and which minimize material requirements are lacking in conventional devices as described below.

For example, U.S. Pat. No. 2,948,078 issued to Miotke discloses a catapult casting device which propels a fish lure or the like to a desired spot on a body of water. The device is also adaptable for shooting arrows and darts. The main body is cylindrical in shape having a depending hand grip portion attached thereto. The hand grip portion is provided with finger grooves to aid in grasping the device. The main body portion is provided with a large central aperture. Above the back portion of the handle are a pair of diametrically opposed slotted ears for retaining an elastic medium on each side. A projectile seating member or patch joins the elastic medium to form a single stretchable entity. The elastic medium is arranged substantially collinear with the central axis of the aperture.

U.S. Pat. No. 3,108,583 issued to Andis discloses a multiple embodiment projectile launcher which has the appearance of a conventional fishing rod. The launcher comprises a stock having a barrel extending therefrom. The barrel has a track with a projectile cup mounted thereto and traverses the barrel in a longitudinal direction. An elastic medium is attached to the cup for propelling the cup up to a certain point. A stopping mechanism is disposed along the track for stopping and subsequently dislodging a projectile. The projectile cup has a plurality of grooves for connecting a plurality of elastic members thereto. A reel is attached at the base of the rod with a line attachment support disposed on the front end of the rod. The device is also adaptable for mounting a bow and arrow assembly.

U.S. Pat. No. 4,014,126 issued to Samuels et al discloses a slingshot casting attachment for a fishing rod. The attachment is clamped to a fishing rod and extends forwardly with pivoting spring arms. When the arms are swung back to a vertical position, they become fixed, and an elastic sling extends rearwardly, therefrom. The sling frame is made of companion sections of sturdy strip metal. Each arm is also swingable downwardly to lock as props for supporting the fishing rod on the ground or on the deck of a boat.

U.S. Pat. No. 4,583,513 issued to Ellenburg et al. discloses a foldable wrist braced slingshot having a yoke and a hand grip which stores and dispenses ammunition, Ammunition dispenses from the base of the hand grip via a swivel stopper or closure disposed thereto A wrist brace is frictionally, detachably and pivotably mounted to the hand grip near its base. The yoke comprises a forked portion and a double over stem portion wherein the inside base of the stem portion contains a slot for receiving a respective stem portion of the yoke. An elastic projectile material is attached to the yoke stems in a conventional manner.

U.S. Pat. No. 4,587,943 issued to Ross discloses a fishing slingshot fixture adapted for receiving a fishing reel and a slingshot coupled thereto. The fixture comprises a base plate having a forward extending guide arm with a vertically adjusting fishing line guide eye mounted thereon. A clamping mechanism is provided with the base for quickly and easily mounting a fishing reel to the top of the base plate and for clamping a sling shot behind the base plate. A pair of rods extending from the base of a the hand-grip of the sling shot are inserted within tapered apertures disposed within the base.

U.S. Pat. No. 5,363,584 issued to Lo discloses a slingshot attachment for fishing poles. The slingshot comprises a Y-shaped body having two arms, each of which is provided with a safety pin and an upper tip to which an end of an elastic band in combination with a leather patch is respectively fastened. The Y-shaped body further includes an mechanical attachment having a cylindrical attachment mounted thereto for attachment with a variety of fishing poles or rods. A set screw is disposed within a central side portion of the mechanical element for securing a rod thereto. U.S. Pat. No. 5,501,207 issued to Black discloses an arm braced slingshot device formed by a U-shaped member having elongated legs adapted to extend along opposite sides of a forearm with the bight portion disposed forwardly of a user's hand when gripping a handle transversely extending between the legs. Inverted L-shaped posts are mounted thereon with an elastic sling attached to respective post for deploying a projectile. A counterweight is centrally and detachably disposed forwardly from the posts along a transverse cross bar. A strap having hook and loop fasteners is attached to the forearm portion of the sling for securing the sling to the arm of a user.

U.S. Design Pat. No. Des. 398,696 issued to Gunn illustrates design features of a slingshot line dispenser wherein a reel is disposed at the base of a substantially U-shaped slingshot. The reel further including the attachment of a extension rod for retaining a weighted fishing line within an aperture disposed at the very tip of the extension rod. The reel is shown mounted on left and right sides of the U-shaped frame portion of the slingshot device.

Foreign Patents issued to Larsen (NO 80964), Drennan (GB 2035106), Middleton (GB 2067082) and Townsend (U.S. Pat. No. 2,262,019) disclose slingshot devices of conventional construction, and are of general relevance to the slingshot line dispenser and method according to the invention herein described. The patent of Larsen, in particular, discloses a Y-shaped slingshot device having an extension on one the arms of the slingshot with a reel mounted thereon for retrieving a deployed line.

None of the above inventions and patents, taken either singly or in combination, is seen to describe the instant invention as claimed.

SUMMARY OF THE INVENTION

The slingshot line dispenser and method for deploying radio antennas according to the invention includes a slingshot having a Y-shaped body, forearm rest or brace portion, a forwardly and alternatively rearwardly mounted combination reel and mounting element disposed with respect to the Y-shaped body, and an. energy absorbing element for casting an object attached to the reel. The attached object consists of a weighted line disposed therein. The mounting element is a substantially cylindrical wire having a uniform area, but varies in slope. The reel is mounted to a sturdy wire mounting element at a location where the slope of the wire mount is a maximum. An energy storage element is attached to the free ends of the Y-shaped slingshot body in a conventional way for propelling the weighted line. The slingshot line dispenser Yshaped body and forearm rest portion is manufactured as a single unitary structure. The forearm rest portion has a V-shape and includes an arcuate C-shaped member attached thereto. The body or frame of the line dispenser is constructed of a sturdy and lightweight material. A method of using the device for deploying an antenna above tall objects is also disclosed.

Accordingly, it is a principal object of the invention to provide a slingshot line dispenser and method for deploying an antenna system above tall objects for amateur radio operations.

It is another object of the invention to provide a slingshot line dispenser device which reduces physical exertion by a user for deploying projectiles.

It is a further object of the invention to provide a slingshot line dispenser which is lightweight and simple to use.

Another object of the invention is to provide improved elements and arrangements thereof in an apparatus for the purposes described which is inexpensive, dependable and fully effective in accomplishing its intended purposes.

Still another object of the invention is to provide a slingshot line dispenser and method which maximize propagation conditions by deploying an antenna at a height for best signal transmission and reception.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 2:
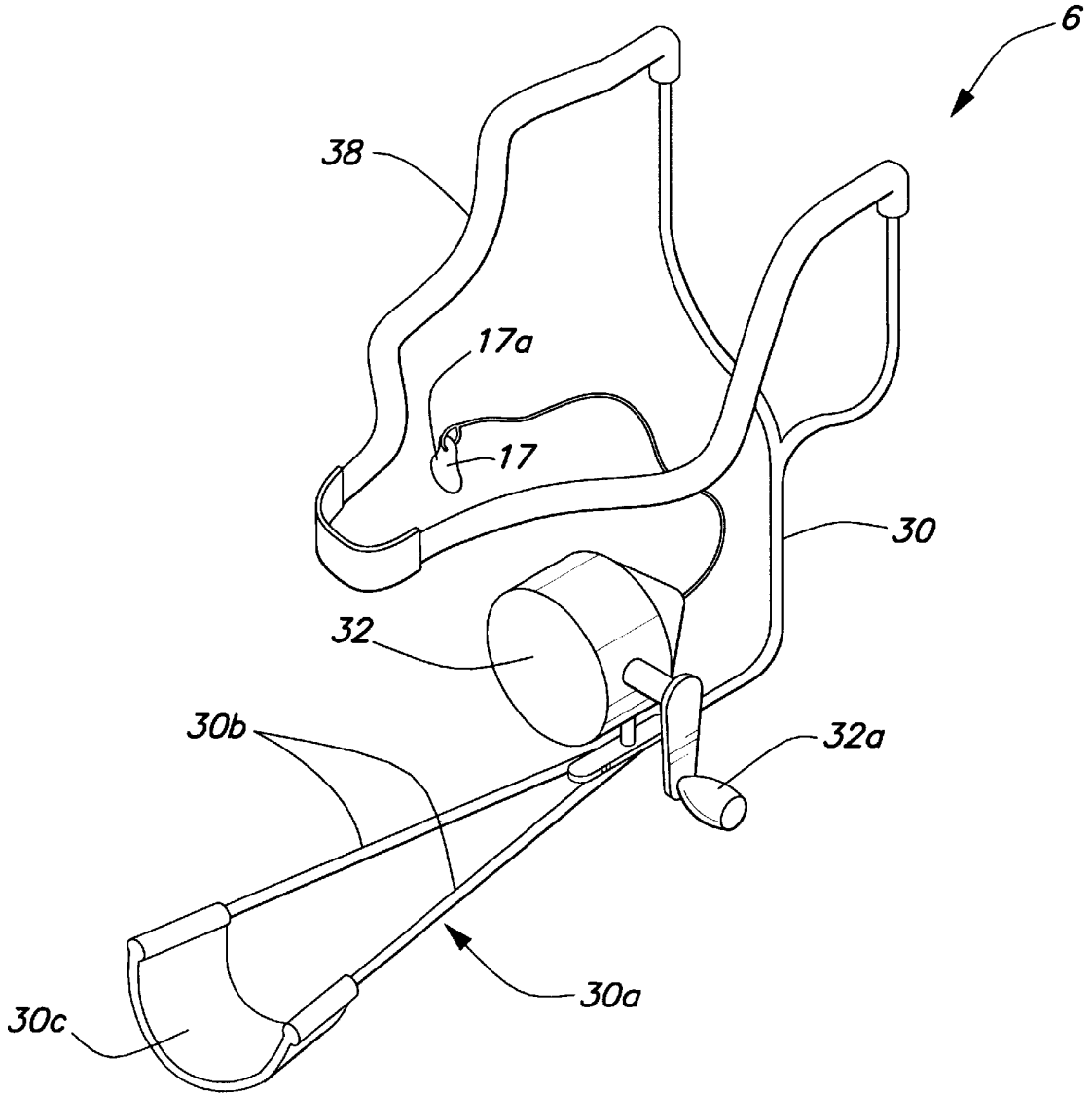
FIG. 2 is a perspective view of the line dispenser according to a first embodiment of the invention.
Figure 3:
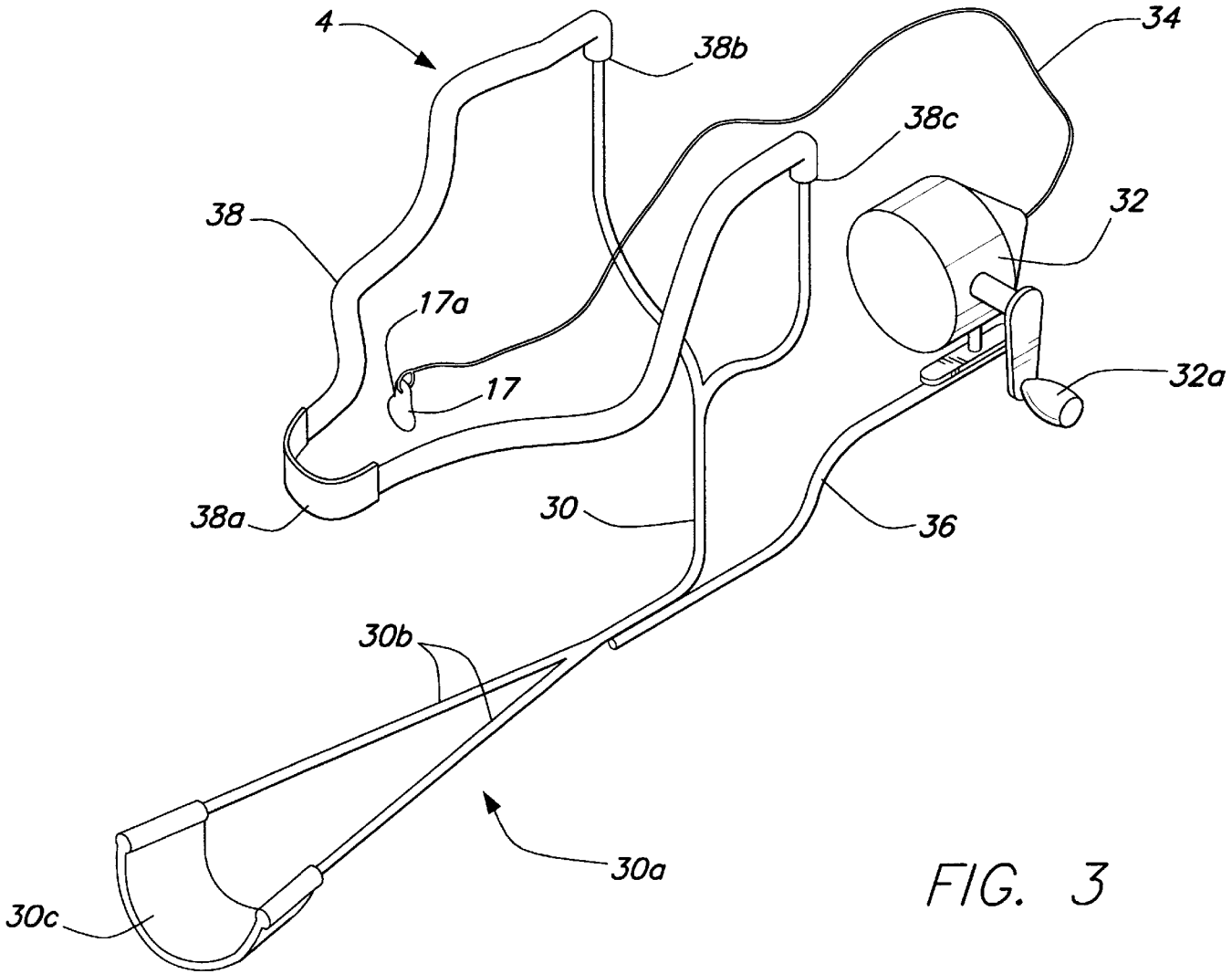
FIG. 3 is a perspective view of the line dispenser according to a second embodiment of the invention.

The present invention is directed to a slingshot line dispenser and method for deploying radio antennas above tall objects T such as trees, buildings, etc. for amateur radio operations. The preferred embodiments of the present invention are depicted in FIGS. 1–3, and are generally referenced by numerals 4, 5, and 6, respectively.

Figure 1A:
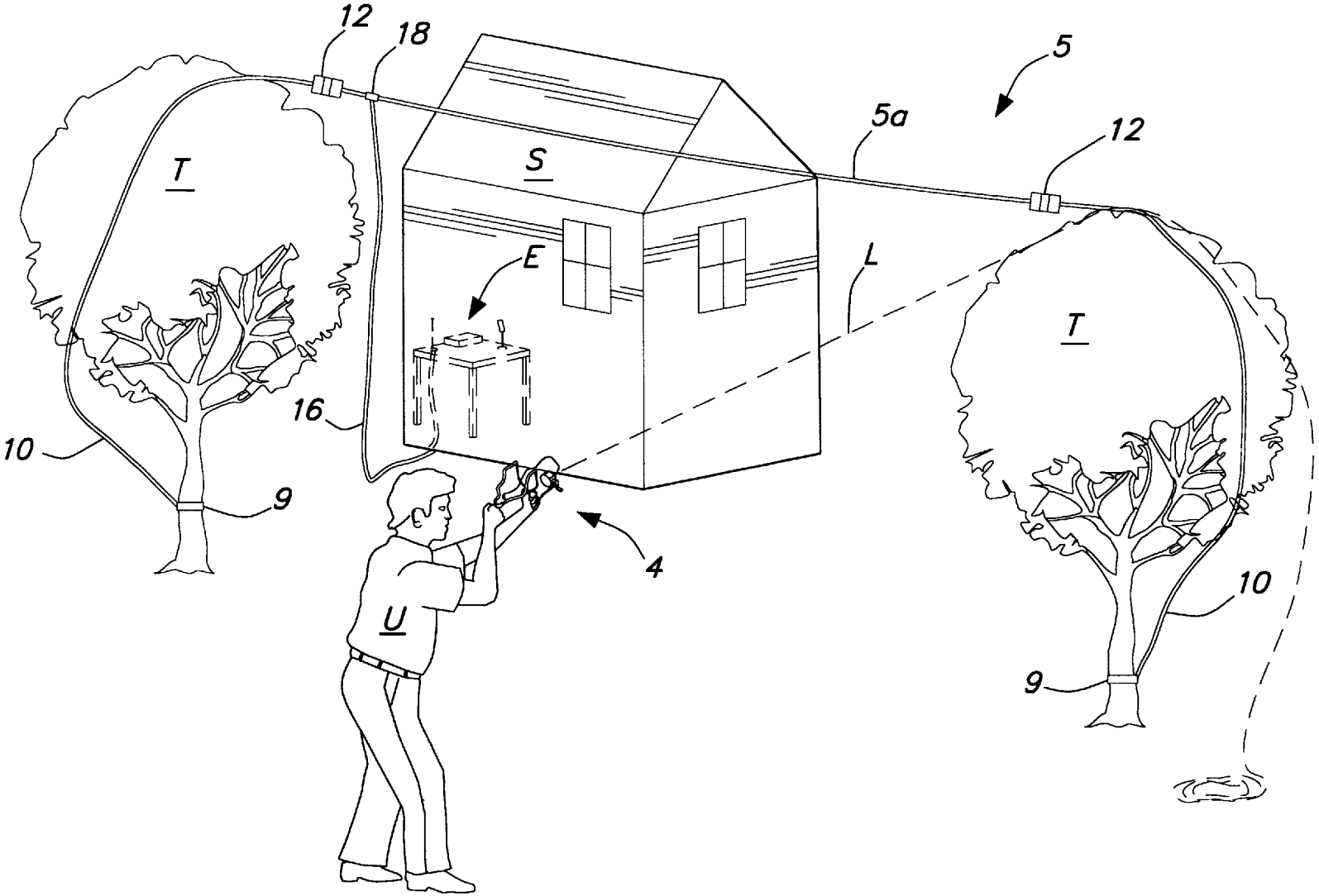
FIG. 1A is an environmental, perspective view of a sling shot line dispenser and antenna deployment according to the present invention.

As best seen in FIG. 1, the slingshot line dispenser 4 according to the preferred embodiment is shown in environmental perspective and in the hands of a user U within the vicinity of a fully deployed antenna system 5. The deployment of system 5 according to the method described below is supported by and secured to the trunk of trees T for meeting optimum height requirements for best signal transmission and reception The coupled connection 9 located at the trunk is a nonconductive support cable 10 connection up to the connection point of an insulator 12. The insulator 12 is coupled to an antenna cable 14 and feed line 16. The feed line 16 is preferably coaxial cable having any number of insulator connections such as coax wrapped around insulators 18 or the like to provide adequate transmission and reception signals as desired by the amateur radio user U. The insulators provide the conventional characteristic of reducing signal leakage and stress or strain at connection points and beyond the coupled antenna cable 5*a* and nonconductive cable connection 10 via cable insulators 12, respectively. An outdoor shelter S is shown having radio transmission and receiving equipment E disposed therein for subsequent antenna system 5 connection via the feed line 16. The dotted line L, depicts the parabolic path of the projectile propelled from the slingshot line dispenser 4. Conventional techniques have utilized arrows having lightweight rope or cable lines attached for this function, however practice has proven the use of arrows to be time consuming, in that they become lodged within certain structures which presents a challenge in subsequent retrieval Error free deployment is critical especially when quick radio deployment is mandatory. The line retrieval technique according to the present invention includes the use of a blunt object or weight 17 which does not suffer the problems associated with the use of arrows. The weight includes an aperture 17*a* for attaching a dispensing line 20 thereto.

Figure 1B:
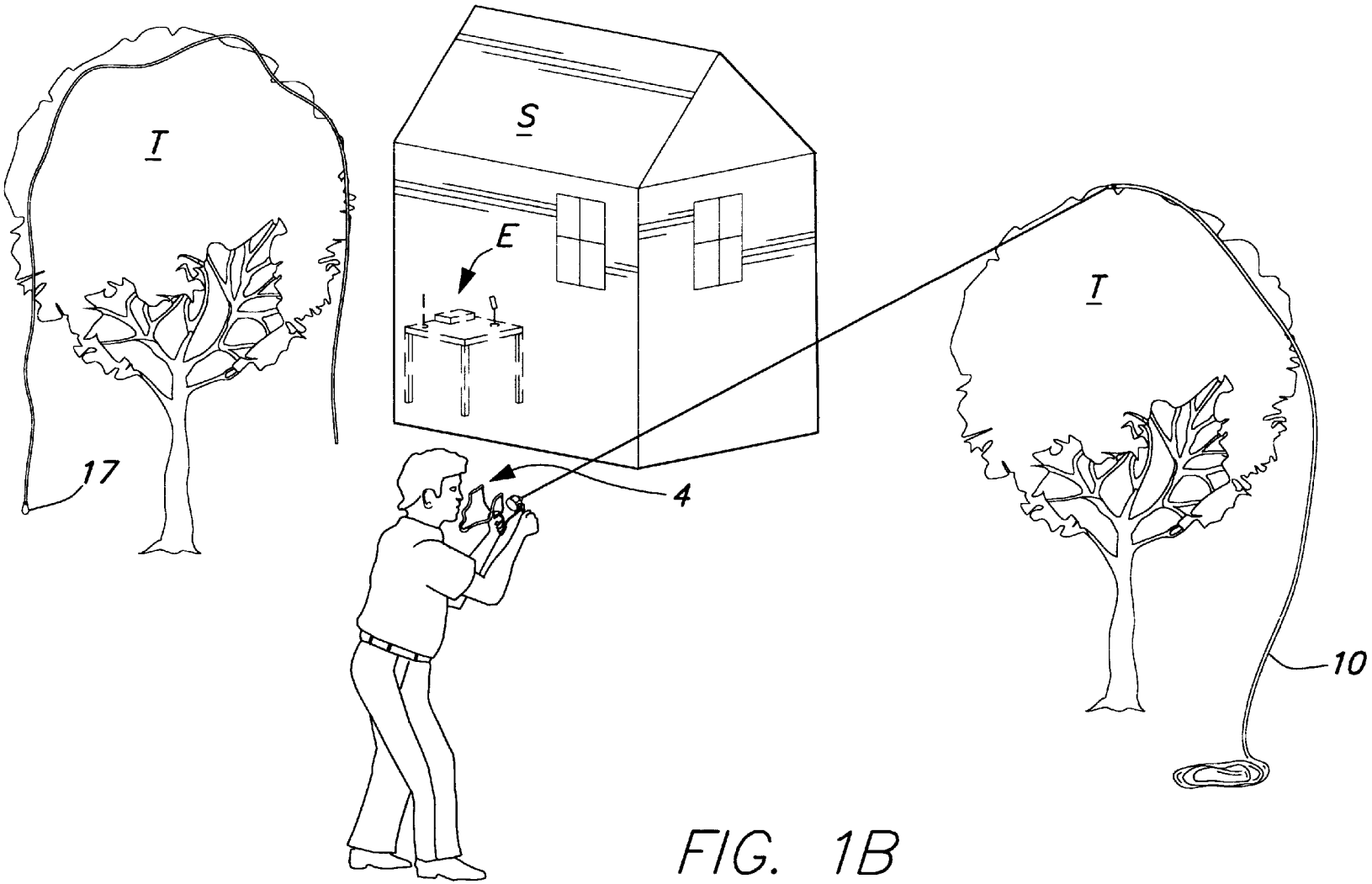
FIG. 1B is a perspective view of the slingshot line dispenser according to the invention, illustrating antenna line retrieval.

As diagrammatically illustrated in FIG. 1B, a user U is shown retrieving an attached support cable 10 over a support object T for partial antenna deployment. As diagrammatically illustrated in FIG. 2, the slingshot line dispenser 6 according to the second embodiment comprises a slingshot device having a Y-shaped body 30, forearm rest or brace portion 30*a*, a reel 32 mounted rearwardly aft the body 30 and having a weighted dispensing line 34 disposed therein. According to the preferred embodiment, FIG. 3 diagrammatically illustrates the slingshot dispensing reel 32 mounted forwardly with respect to the body 30 to a substantially cylindrical and sturdy wire extension 36. The wire structure 36 provides cantilevered support to the reel 32 for greater leverage and reeling support not particularly provided by the second embodiment. This structural feature is beneficial when retrieving the deployed line 34. The second embodiment 4 of the invention which depicts the reel mounted rearwardly and aft the body 30 has the advantage of providing a sturdy support without the tendency of failure due to bending torque. Notwithstanding, the reel 32 in both embodiments is secured to the slingshot 4, 6 via welding or projection molding techniques depending on the material used by one having ordinary skill in the relevant art (i.e. whether metallic or composite plastic material, respectively). Both material methods can be used to make the device according to the invention, so long as the device is dimensioned and configured to provide the necessary structural rigidity to prevent failure as a result of cyclical stresses and/or material fatigue.

The cantilevered structural support 36 has a wire structure with one end attached to the lower portion of the Y-shaped body 30 and extends outward therefrom. Wire support 36 then slopes upward and terminates in an opposite end in order to reduce stress along the support 36, and to maximize leverage from an exerted load or attached support cable 10 in line retrieval 34. Accordingly, the reel 32 is mounted to the wire mount structure 36 adjacent the opposing terminal end of support 36. An energy storage means 38 for propelling the weighted line is preferably made of a stretchable rubber or similar material having a predetermined stiffness constant for propelling objects 17 a predetermined distance. The material is preferably a continuous tubular material having a projectile receiving surface 38*a* and free ends 38*b* and 38*c* for attachment with the upper Y-shaped portions, respectively The stiffness factor of the material 38 can vary depending on the structural material strength properties of the slingshot line dispenser.

Figure 4:
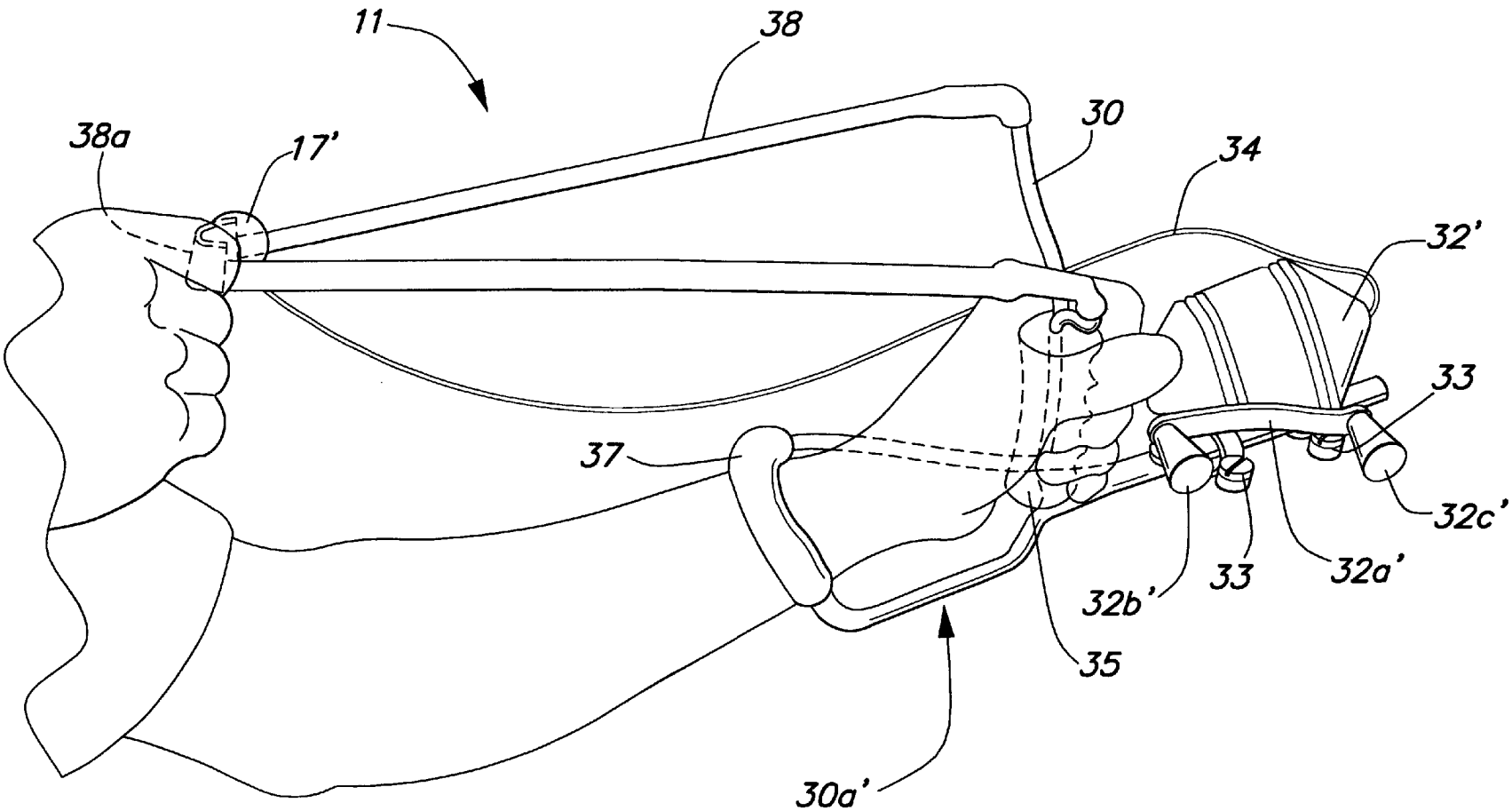
FIG. 4 is a perspective view of the line dispenser according to a third embodiment of the invention.

The Y-shaped body 30 and forearm rest or brace portion 30*a* of both embodiments is formed as a single continuous unit. The forearm portion 30*a* is V-shaped 30*b* and include a C-shaped cup 30*c* attached thereto. As diagrammatically illustrated in FIG. 4, the sling shot line dispenser 11 is shown according to a third embodiment comprising similar features such as a blunt object or weight 17', a Y-shaped body 30, forearm brace portion 30*a'*, a fishing reel 32' having a reeling arm 32*a'* with dual handle knobs 32*b'* and 32*c'*, a monofilament dispensing line 34, a gripping member 35, an arm brace support cushion 37, energy storage means 38 having a projectile (17') receiving surface patch 38*a* attached thereto. A number of materials can be used for each embodiment as herein disclosed such as stainless steel, aluminum, composite plastics, etc. The material should be selected for reducing material degradation related to rust, corrosion and/or plastic deformation. Accordingly, the method of deploying the antenna system 5 for amateur radio operations utilizing the slingshot line dispensers according to the invention includes the following general steps of:

(a) projecting the weighted line over a first tall object,
  (1) retrieving the weighted end of the line for connecting the line to a first preselected cable,
  (2) mounting the unattached end of the preselected cable to the first object as a nonconductive connection,
  (3) reeling the connected cable over a tall object for connection with a antenna cable,
  (4) removing the weighted line from the first preselected cable, and
  (5) coupling the first preselected cable to an antenna line (b) projecting the weighted line over a second tall object comparable in height of the first object,
  (1) retrieving the weighted end of the line for connecting the line to a second preselected cable,
  (2) mounting the unattached end of the preselected cable to the second object as a nonconductive connection, and for subsequent adjustments,
  (3) reeling the connected cable over the tall object for connection with a antenna cable in combination with the first cable,
  (4) removing the weighted line from the second preselected cable,
  (5) coupling the second preselected cable to the antenna line in combination with the first preselected cable, and
  (6) adjusting the nonconductive second connection to provide maximum antenna height between the first and second objects, and
  (7) connecting the antenna line for radio operation.

The advantages of the apparatus and method as herein described allows the amateur radio enthusiasts to achieve radio frequencies on several bands or over a large continuous portion of the high frequency (hf) spectrum as an economical all band system. The antenna is deployed to reach frequencies up to and near those produced by "Multi-element Directive arrays". In this regard, it is to be understood that the present invention is not limited to the sole embodiments described above, but encompasses any and all embodiments within the scope of the following claims.

I claim:

1. A slingshot line dispenser for deploying radio antennas comprising, a slingshot having a Y-shaped body including a lower portion, a forearm brace portion, a forwardly extended reel and mount, the reel having a weighted line disposed therein, and the mount being a substantially cylindrical wire having a first end attached to the lower portion of said Y-shaped body and extending outward therefrom, said wire then sloping upward and terminating in a second end, the reel being mounted adjacent the second end of said wire; and an energy storage means for propelling the weighted line.

2. The slingshot line dispenser according to claim 1, wherein the Y-shaped body and forearm brace form a single continuous unit, the forearm brace having a V-shape and including a C-shaped cup attached thereto.

3. The slingshot line dispenser according to claim 2, wherein the Y-shaped body and forearm brace form a single continuous sturdy metallic unit.

4. The slingshot line dispenser according to claim 2, wherein the Y-shaped body and forearm brace form a single continuous composite plastic unit.

5. The slingshot line dispenser according to claim 1, wherein the slingshot body and extension wire is made of a sturdy metallic material.

6. The slingshot line dispenser according to claim 1, wherein the slingshot body and wire mount is made of a composite plastic material.

7. A method of deploying antenna cable for amateur radio operations utilizing the slingshot device of claim 1, including the steps of:

(a) projecting the weighted line over a first tall object,
  (1) retrieving the weighted end of the line for connecting the line to a first preselected cable,
  (2) mounting the unattached end of the preselected cable to the first object as a nonconductive connection,
  (3) reeling the connected cable over the first tall object for connection with a antenna cable,
  (4) removing the weighted line from the first preselected cable, and
  (5) coupling the first preselected cable to an antenna line (b) projecting the weighted line over a second tall object comparable in height of the first object,
  (1) retrieving the weighted end of the line for connecting the line to a second preselected cable,
  (2) mounting the unattached end of the preselected cable to the second object as a nonconductive connection, and for subsequent adjustments (3) reeling the connected cable over the second tall object for connection with a antenna cable in combination with the first cable, (4) removing the weighted line from the second preselected cable, (5) coupling the second preselected cable to the antenna line in combination with the first preselected cable, (6) adjusting the nonconductive second connection to provide maximum antenna height between the first and second objects, and (7) connecting the antenna line for radio operation.

* * * * *